US009425550B2

(12) United States Patent
Cho et al.

(10) Patent No.: US 9,425,550 B2
(45) Date of Patent: Aug. 23, 2016

(54) LEVER TYPE CONNECTOR HAVING RESPECTIVE FIXATION PROTRUSIONS WITH DIFFERENT SHAPES

(71) Applicants: HYUNDAI MOTOR COMPANY, Seoul (KR); KIA MOTORS CORPORATION, Seoul (KR)

(72) Inventors: Hyun Yong Cho, Seoul (KR); Jin Soo Ryu, Yongin-si (KR); Bong Hun Choi, Incheon (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 14/720,692

(22) Filed: May 22, 2015

(65) Prior Publication Data

US 2016/0134052 A1 May 12, 2016

(30) Foreign Application Priority Data

Nov. 10, 2014 (KR) ..... 10-2014-0155687

(51) Int. Cl.
*H01R 13/62* (2006.01)
*H01R 13/629* (2006.01)

(52) U.S. Cl.
CPC ..... *H01R 13/62938* (2013.01)

(58) Field of Classification Search
CPC ..... H01R 13/62933; H01R 13/62938; H01R 13/62988
USPC ..... 439/157, 372
See application file for complete search history.

(56) References Cited

U.S. PATENT DOCUMENTS

| | | | | |
|---|---|---|---|---|
| 6,447,312 | B1 * | 9/2002 | Takata | H01R 13/62938 439/157 |
| 9,018,550 | B2 * | 4/2015 | Kobayashi | H01H 9/0066 200/50.01 |
| 2002/0025704 | A1 | 2/2002 | Takata | |
| 2006/0051994 | A1 | 3/2006 | Fujii | |
| 2008/0096397 | A1 | 4/2008 | Tajiri et al. | |
| 2012/0318645 | A1 * | 12/2012 | Kobayashi | H01H 9/0066 200/50.01 |

FOREIGN PATENT DOCUMENTS

| | | | |
|---|---|---|---|
| JP | 2001-076812 | A | 3/2001 |
| JP | 2002-025691 | A | 1/2002 |
| JP | 2006-073464 | A | 3/2006 |
| JP | 2008-103223 | A | 5/2008 |
| JP | 2008-300236 | A | 12/2008 |
| JP | 2012-243559 | A | 12/2012 |
| KR | 10-2010-0070848 | A | 6/2010 |
| KR | 10-1189576 | B1 | 10/2012 |
| KR | 10-2013-0037753 | A | 4/2013 |

* cited by examiner

*Primary Examiner* — Hae Moon Hyeon
(74) *Attorney, Agent, or Firm* — McDermott Will & Emery LLP

(57) ABSTRACT

A lever type connector includes a housing capable of accommodating a terminal in an outlet; and levers connected onto both sides of the housing, respectively so as to pivot in a detachable direction of the terminal. In the housing, fixation protrusions, connected with the levers, are formed on both sides of the housing, respectively, and the respective fixation protrusions have different shapes.

5 Claims, 7 Drawing Sheets

LEVER TYPE CONNECTOR HAVING RESPECTIVE FIXATION PROTRUSIONS WITH DIFFERENT SHAPES

CROSS-REFERENCE TO RELATED APPLICATION

This application is based on and claims the benefit of priority to Korean Patent Application No. 10-2014-0155687, filed on Nov. 10, 2014 in the Korean Intellectual Property Office, the disclosure of which is incorporated herein by reference in its entirety.

TECHNICAL FIELD

The present disclosure relates to a lever type connector, and more particularly, to a lever type connector that prevents reverse lever rotation.

BACKGROUND

An electrical connector installed to connect a wire harness to an electric connection box or branch and connect a type such as the wire harness includes a connector holder capable of accommodating a plurality of female terminals and a male side connector capable of accommodating male terminals corresponding to the female terminals of the connector holder and fittable with the connector holder. In the electrical connector, in order to easily join the connector holder and the male-side connector, a vertically rotatable lever (also referred to as 'lever connector') is usually installed in the connector holder.

The lever has a substantially U shape on a plane in which a base is rotatably connected to left and right outer surfaces of a housing of the connector holder. The connector holder is inserted into the male-side connector up to a half-fit location, and thereafter, the lever is rotated. A point latch portion installed at the lever is latched to a latched portion installed at the male-side connector, and the connector holder is joined next to interlock with the male-side connector by a lever principle.

In the related art, a direction is set so that a lever fixation protrusion of the housing and a fastening groove of the lever coincide with each other, and thereafter, the lever is extended horizontally to assemble the lever to the housing. However, when the lever is assembled to the housing, misassembly by a worker may occur by mistaking left and right directions of the lever. Further, since the force for fixing the lever is weak, the lever may become separated from a fixed location when articles move. That is, misassembly or excessive rotation may occur due to a mistake by the worker at the time of rotating the lever, and the lever may be rotated in reverse upon an impact when the articles move. In this case, exchange of the housing and reworking of the terminal inserted into the housing are required.

SUMMARY

The present disclosure has been made to solve the above-mentioned problems occurring in the prior art while advantages achieved by the prior art are maintained intact.

Aspects of the present disclosure provide:

First, misassembly is prevented by a worker joining a housing and a lever;

Second, reverse rotation, which may occur while a worker is assembling and moving a connector, is prevented;

Third, a structure for improving workability and quality of product is provided;

The objects of the present disclosure are not limited to the aforementioned objects, and other objects, which are not mentioned above, will be apparent to those skilled in the art from the following description.

According to an exemplary embodiment of the present disclosure, a lever type connector includes a housing capable of accommodating a terminal in an outlet; and levers connected onto both sides of the housing, respectively so as to pivot in a detachment direction of the terminal, wherein, in the housing, fixation protrusions connected with the levers are formed on both sides of the housing, respectively and the respective fixation protrusions have different shapes.

Other detailed contents of the exemplary embodiments are included in the Detailed Description and the drawings.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
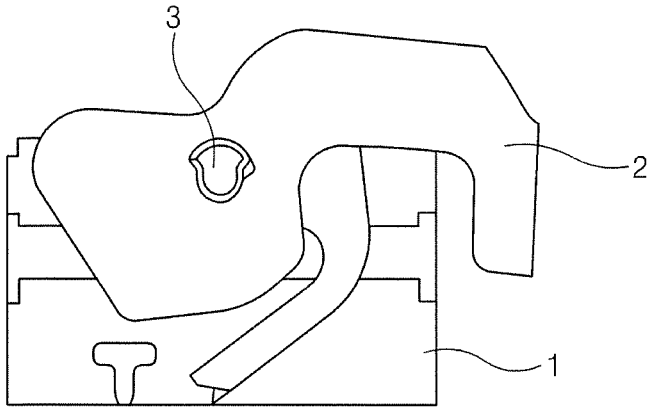
FIG. 1 is a side view of a lever type connector according to an exemplary embodiment of the present disclosure.

Various advantages and features of the present disclosure and methods accomplishing thereof will become apparent from the following description of exemplary embodiments with reference to the accompanying drawings.

However, the present disclosure is not limited to the exemplary embodiment disclosed herein but will be implemented in various forms. The exemplary embodiments introduced herein are provided to make disclosed contents thorough and complete and sufficiently transfer the spirit of the present disclosure to those skilled in the art. Therefore, the present disclosure will be defined only by the appended claims. Like reference numerals indicate like elements throughout the specification.

Hereinafter, the present disclosure will be described with reference to the accompanying drawings for describing a lever 2 type connector by exemplary embodiments of the present disclosure.

FIG. 1 is a side view of a lever 2 type connector according to an exemplary embodiment of the present disclosure.

Figure 2A:
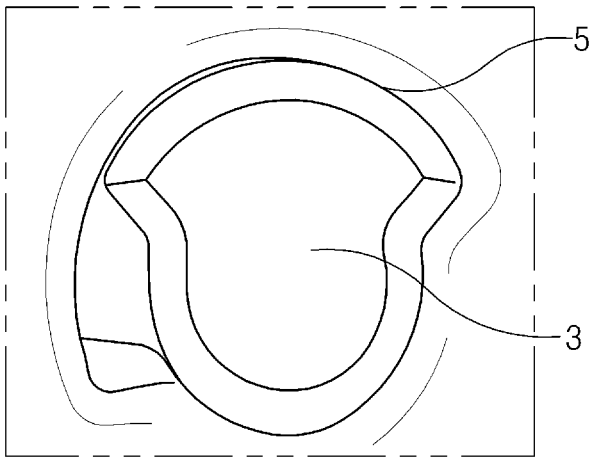
FIGS. 2A and 2B illustrate a fixation protrusion and a fixation hole according to the exemplary embodiment of the present disclosure.
Figure 2B:
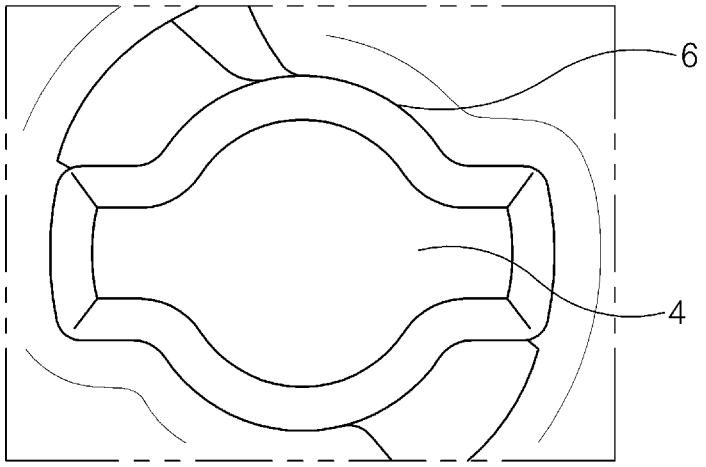

FIGS. 2A and 2B illustrate fixation protrusions 3 and 4 and fixation holes 5 and 6 according to the exemplary embodiment of the present disclosure. The lever 2 type connector according to the exemplary embodiment of the present disclosure includes a housing 1 capable of accommodating a terminal in an outlet; and levers 2 connected onto both sides of the housing 1, which are pivotable in a detachment direction of the terminal. In the housing 1, the fixation protrusions 3 and 4, connected with the lever 2, are formed on both sides of the housing, respectively and the respective fixation protrusions 3 and 4 have different shapes.

The lever 2 has a substantially 'U' shape configuration and the fixation holes 5 and 6, into which the fixation protrusions 3 and 4 are inserted, are formed at both ends of the lever 2, and the respective fixation holes 5 and 6 similarly have different shapes. The shapes of the left and right protrusions of the housing 1 are different from each other to prevent misassembly by a worker.

Figure 3:
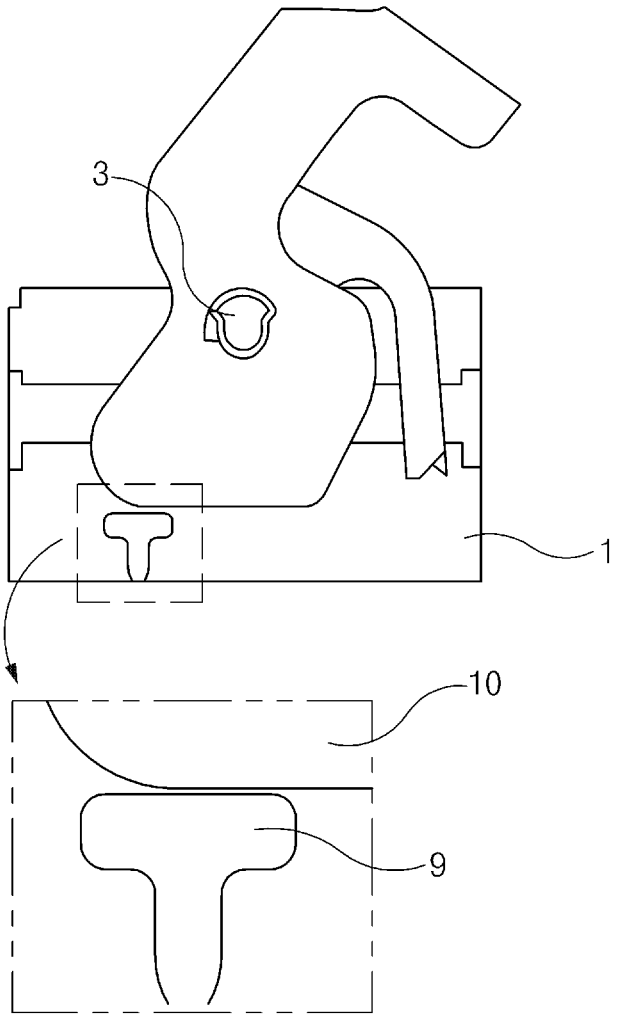
FIG. 3 illustrates a lever suspended on an over-rotation prevention rib according to the exemplary embodiment of the present disclosure.

FIG. 3 illustrates the lever 2 suspended on an over-rotation prevention rib 9 according to the exemplary embodiment of the present disclosure. In the housing 1, the over-rotation prevention rib 9 regulating a rotational angle of the lever 2 protrudes, and a suspension surface 10 which is suspended on the over-rotation prevention rib 9 is formed in the lever 2. The over-rotation prevention rib 9 is formed at each of left and right sides. Since over-rotation of the lever 2 is prevented by the over-rotation prevention rib 9, damage to the lever 2 may be prevented during operation.

Figure 4A:
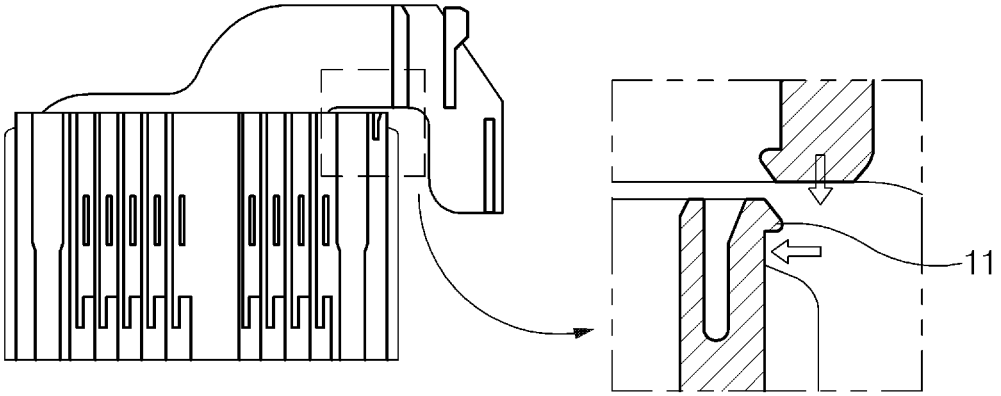
FIG. 4A illustrates a lever location when female and male connectors are joined.
Figure 4B:
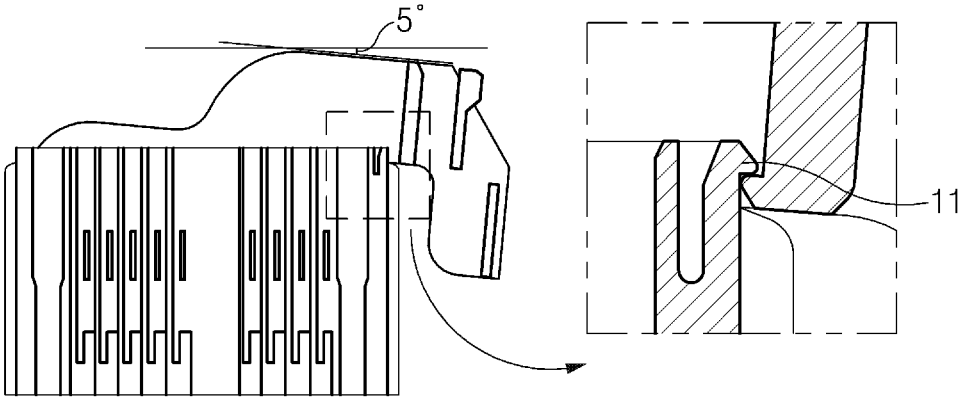
FIG. 4B illustrates a state in which the lever is suspended on the housing.

FIG. 4A illustrates a lever 2 location when female and male connectors are joined, and FIG. 4B illustrates a state in which the lever 2 is suspended on the housing 1. In the housing 1, a hook 11 that suspends and fixes the lever 2 is formed at a location where locking with the lever 2 does not occur when the housing 1 and the male connector 20 are joined to each other.

The hook 11 is suspended on the lever 2 when the lever 2 is inclined at −5°.

When the strength to fix the lever 2 is increased, an anchoring location of the lever 2 may be prevented from being separated when articles are moved. However, when the male and female connectors are separated from each other after the connectors are joined to each other, the forces to release the male and female connectors and anchor the lever 2 are doubled.

As a result, workability deteriorates. Accordingly, the present disclosure provides a structure in which, by setting an anchoring angle of the lever 2 to −5°, the lever 2 is not anchored and locked when the male and female connectors are joined to each other (an angle of 0°). As a result, the strength of anchoring the lever 2 may be maximized. Further, insertion is easily performed by the structure of the housing 1 when the lever 2 is fixed, and it is preferable to set a suspension degree so that astrength of force having approximately 3.5 kgf is generated, which will not release the lever 2 at the time of moving the articles when the lever 2 is released.

Figure 5:
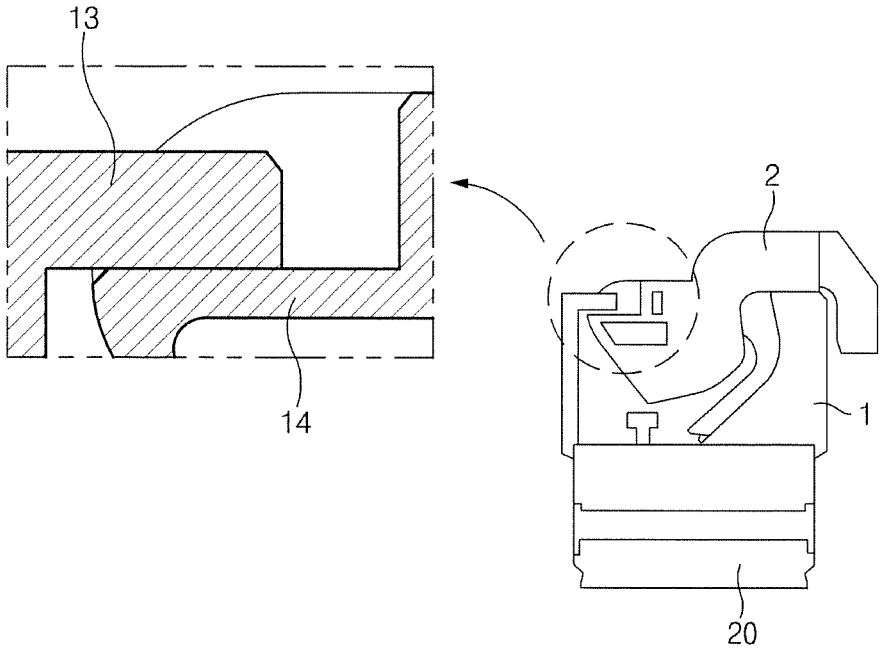
FIG. 5 illustrates the lever suspended on a mealing prevention jaw.

FIG. 5 illustrates the lever 2 suspended on a mealing prevention jaw. In the housing 1, the mealing prevention jaw 13 that regulates the movement of the lever 2 is formed so that the lever 2 does not move in a suspension direction on the hook 11 after the lever 2 is suspended on the hook 11. The mealing prevention jaw 13 is formed in the housing 1 to prevent mealing of the connector. An 'L'-shaped mealing prevention protrusion 14 corresponding to the mealing prevention jaw 13 is formed at the lever 2.

Figure 6A:
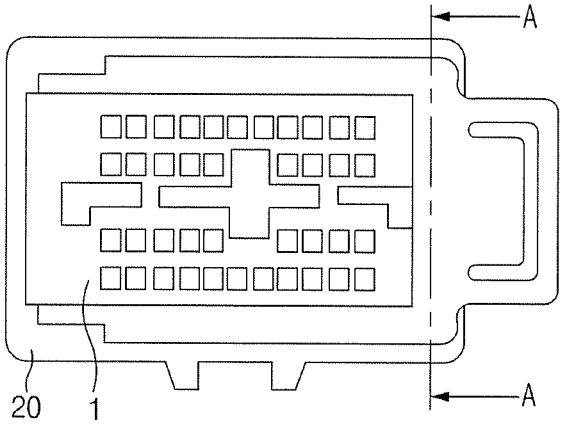
FIG. 6A-6C illustrates a gradient structure according to the exemplary embodiment of the present disclosure.
Figure 6B:
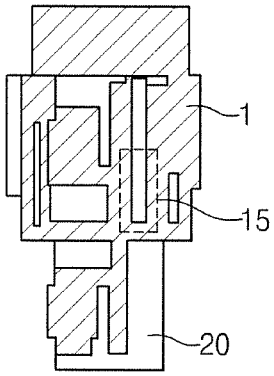
Figure 6C:
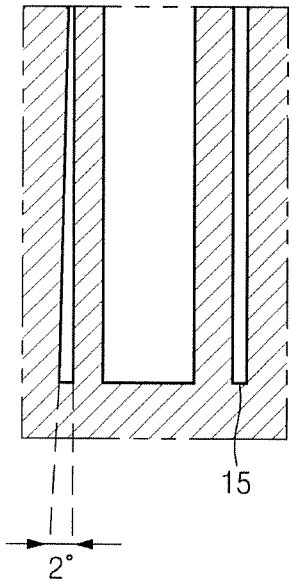

FIG. 6A-6C illustrates a gradient structure according to the exemplary embodiment of the present disclosure. A gradient 15 is formed in the housing 1 so that a gap is minimized when the housing 1 and the male connector 20 are joined to each other.

A connector gap minimization gradient 15 structure is applied to the housing 1 and/or the lever 2 in order to minimize the connector gap.

According to the present disclosure, when the lever 2 and the housing 1 are joined to each other, misassembly of the lever 2 may be anticipated by a worker by left and right protrusion configurations having different shapes, and deformation of the product is prevented through the reverse rotation preventing structure.

Further, the lever fixation lock is set to −5° to prevent the fixation location of the lever 2 from being separated and to improve terminal insertability, and a mealing prevention structure and the gap minimization gradient 15 structure are applied to prevent same and minimize the connector gap. In general, a worker's mistake and a risk factor on moving the articles are reflected in a design to improve workability and quality of the product.

According to the exemplary embodiments of the present disclosure, the following effects are provided.

First, worker misassembly is prevented when joining the housing and the lever.

Second, reverse rotation, which may occur by a worker-when assembling and moving the connector, is prevented.

Third, a structure for improving workability and quality of a product is provided.

The effects of the present disclosure are not limited to the aforementioned effects, and other effects, which are not mentioned above, will be apparent to those skilled in the art from the description included in the appended claims.

Although the preferred embodiments of the present disclosure have been disclosed for illustrative purposes, those skilled in the art will appreciate that various modifications, additions and substitutions are possible, without departing from the scope and spirit of the disclosure as disclosed in the accompanying claims. Accordingly, such modifications, additions and substitutions should also be understood to fall within the scope of the present disclosure.

What is claimed is:

1. A lever type connector comprising:

a housing capable of accommodating a terminal; and levers connected onto both sides of the housing, respectively so as to pivot in a detachment direction of the terminal, wherein the housing includes: fixation protrusions connected with the levers and formed on both sides of the housing, respectively, in which the respective fixation protrusions have different shapes; a hook that suspends and fixes the lever; and a mealing prevention jaw regulating movement of the lever and preventing the lever from further suspending, and wherein the lever includes a mealing prevention protrusion corresponding to the mealing prevention jaw.

2. The lever type connector according to claim 1, wherein the lever has a substantially 'U' shape, wherein the lever includes fixation holes, into which the fixation protrusions are inserted, formed at both ends of the lever, respectively, and wherein the respective fixation holes have different shapes.

3. The lever type connector according to claim 1, wherein the housing further includes an over-rotation prevention rib that regulates a rotational angle of the lever protrudes, and wherein the lever further includes a suspension surface suspended on the over-rotation prevention rib.

4. The lever type connector according to claim 1, wherein the hook is formed at a location where locking with the lever does not occur when the housing and a male connector are joined to each other, and wherein the hook is suspended on the lever when the lever is inclined at −5°.

5. The lever type connector according to claim 4, wherein a connector gap minimization gradient structure is formed in the housing so that a gap is minimized when the housing and the male connector are joined to each other.

* * * * *